US005282765A

United States Patent [19]

Suzuki

[11] Patent Number: 5,282,765

[45] Date of Patent: Feb. 1, 1994

[54] SAVINGS BOX

[75] Inventor: Tooru Suzuki, Tokyo, Japan

[73] Assignee: Tenyo Co., Ltd., Tokyo, Japan

[21] Appl. No.: 943,531

[22] Filed: Sep. 11, 1992

[30] Foreign Application Priority Data

Dec. 19, 1991 [JP] Japan ..... 3-104977[U]

[51] Int. Cl.[5] ..... A63H 33/00; A63J 5/00

[52] U.S. Cl. ..... 446/8; 232/1 D; 472/63

[58] Field of Search ..... 446/8; 232/1 D, 4 R; 472/63

[56] References Cited

U.S. PATENT DOCUMENTS 4,094,501 6/1978 Burnett ..... 472/63

4,967,953 11/1990 Sugawara ..... 232/1 D

*Primary Examiner*—Mickey Yu

*Attorney, Agent, or Firm*—Sixbey, Friedman, Leedom & Ferguson

[57] ABSTRACT

The present invention aims at providing a savings box enjoyable to see. A partition is provided in the internal space of a box body to divide the internal space thereof into two spaces. There is formed in the partition a cut to provide a communication between the two spaces. A window is formed in the front plate of the box body which faces the partition and a mirror is provided on the partition. A camouflaging member is provided on the mirror and a compartment is so provided below the camouflaging member to cover the cut. An optical member is provided at an opening in the compartment. A coin is thrown into the compartment from a coin slot formed in the box body. When viewed through the optical member, the coin put in the box body is seen as if it were reduced in size. Although the coins are actually placed in the compartment and reception space, they are seen as if they counted a larger number than the capacity of the compartment. Namely, this savings box is enjoyable to see.

17 Claims, 16 Drawing Sheets

SAVINGS BOX

BACKGROUND OF THE INVENTION a) Field of the Invention

The present invention relates to an enjoyable-to-see savings box in which a reflecting surface or mirror is used for a coin thrown into the coin compartment to look as if it had been reduced in size and also for the coins received in the compartment to look as if they counted a larger number than the capacity of the compartment.

b) Prior Art Statement

Magic devices of this kind using a mirror are well known. A typical one of such devices is a magic cabinet disclosed in, for example, "Hoffmann's Modern Magic" by Professor Hoffmann (Angelo John Lewis), pp 476 to 477. As illustrated in FIG. 1, a hollow cabinet indicated with A has provided at the front thereof folding doors B which can be freely closed and opened. The cabinet A has also provided therein a post C standing in the center thereof. Movable flaps D are provided as hinged at one side thereof at either rear corner of the cabinet A. The free sides of these flaps D are circularly movable between the post C and both the right and left sides, respectively, inside the cabinet A. Each of the flaps D has a reflecting surface E provided on the entire front side thereof.

An example use of this magic device is as follows:

The exhibitor sets a skeleton behind the flap D and closes the flap D beforehand. He opens the doors B of the cabinet A and directs his assistant to walk into the cabinet A. Then he closes the doors B of the cabinet A. The assistant in the cabinet A opens the flap D, relocates the skeleton having been set behind the flap B to the front of the flap D, closes the flap D and hides himself behind the flap D. Thereafter the exhibitor opens the doors B of the cabinet A. The audience will be surprised to see the skeleton standing in the assistant's place.

In this magic device, since the inner walls of the cabinet A are seen on the reflecting surfaces E on the front sides of the flaps D, the audience will be given an illusion that the cabinet A is empty without the flaps D.

However, since this magic device is of a large volume, it cannot be applied as it is as a savings box for personal use at home.

SUMMARY OF THE INVENTION

The present invention has an object to provide a savings box for personal use at home and enjoyable to see.

The above object can be accomplished by providing a savings box in which there is provided in a box body consisting of an opaque enclosure a partition lying in two planes defining an arbitrary angle between them to divide the internal space of the box body into a first space including the larger one of the angles defined between the two planes and a second space including the smaller angle; a cut is formed in the partition to provide a communication between the first and second spaces in the box body; a light-transparent window is provided which forms a part of the first space of the box body and which is located between the lines of intersection between two planes extending from the line of bending of the partition perpendicularly to the two planes, respectively; a light reflecting area is provided over the two planes of the partition at the first space side; a coin slot is formed in the box body to communicate with the second space; a light-opaque camouflaging member is so secured to the partition as to cover the bending line at the light reflecting area side; a light-opaque compartment is so provided contiguously to the camouflaging member as to cover the cut; an opening is formed in the compartment to show the compartment inside and the second space through the cut; and an optical means is provided at the opening of the compartment to provide a reduced-in-scale view of the compartment inside and the second space.

The savings box according to the present invention is so arranged that when the coin compartment is viewed through the window, the coin received there looks smaller because of the optical means provided. Therefore, the coin put into the compartment through the coil slot in the box body looks as if it had been reduced in size when passing through the camouflaging member before received in the compartment.

In the savings box according to the present invention, the internal space of the box body is divided into two sub-spaces, of which the one facing the window (will be referred to as "coin reception space" hereafter) is concealed by the partition. In the other sub-space (will be referred to as "magic space" hereafter), the inner walls thereof, camouflaging member and the outer surfaces of the coin compartment are seen as reflected on the light reflecting area (will be referred to as "mirror" hereafter) so that the inner walls of the magic space is seen on the mirror as if they were the inner wall of the coin reception space behind the partition, and the outer surfaces of the camouflaging member and the coin compartment are also seen there as if they formed the complete bodies of the member and compartment, respectively, which would otherwise be. Namely, when a glance is taken of the inside of the box body through the window, an illusion can be given that there exists a coin chute (camouflaging member) and a coin storage box (coin compartment) in a hollow box having no partition therein.

The coins actually put in the coin reception space and coin compartment will look as if they were received only in the coin compartment. Hence, the coins in the compartment look as if they were stored there as reduced in size, counting a larger number than the capacity of the coin compartment.

Thus, the savings box according to the present invention is enjoyable to see.

BRIEF DESCRIPTION OF THE DRAWINGS

FIGS. 2 to 16 show together an embodiment of the savings box according to the present invention, of which FIG. 2 is an exploded perspective view of the box body and window (transparent plate);

FIG. 3 is also an exploded perspective view of the partition, camouflaging member, coin compartment, etc. provided inside the box body;

FIG. 4 is an exploded perspective view of the mirror and pattern-printed sheets;

FIG. 5 is a perspective view of the savings box in use, showing the throwing of a coin into the box and the coin stored in the coin compartment as reduced in size;

FIG. 6 is a front view of the coins box;

FIG. 7 is a sectional view taken along the line VII—VII in FIG. 6;

FIG. 8 is a sectional view of a part of the savings box, showing the tray drawn out;

FIG. 9 is a sectional view taken along the line IX—IX in FIG. 6;

FIG. 10 is a bottom view of the savings box;

FIG. 11 is a rear view of the savings box with the rear plate removed from the box body;

FIG. 12 is a rear view of the partition;

FIG. 13 is a rear view showing the partition set in the box body and the rear plate removed therefrom;

FIG. 14 is a sectional view of a part of the savings box, showing the connection between the camouflaging member and coin compartment;

FIG. 15 is an explanatory drawing showing the principle of the savings according to the present invention; and FIG. 16 is a sectional view taken along the line XVI—XVI in FIG. 5, showing the principle of the savings box according to the present invention.

DETAILED DESCRIPTION OF THE PREFERRED EMBODIMENT

FIGS. 1 to 16 show together an embodiment of the savings box according to the present invention.

Figure 1:
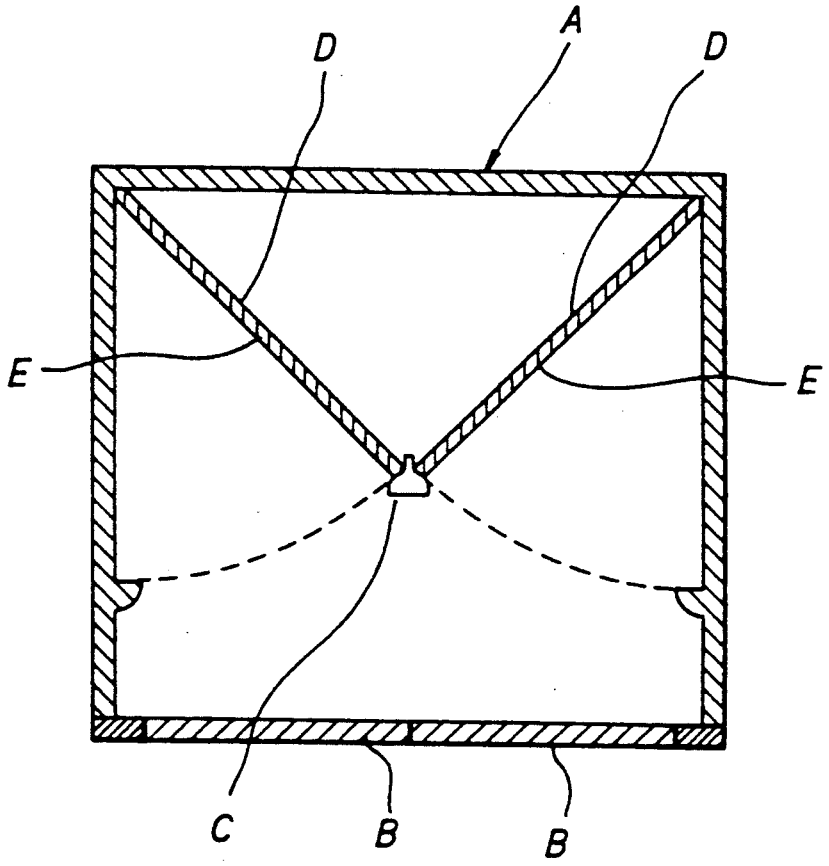
FIG. 1 PRIOR ART
FIG. 1 is a cross-sectional view of the prior-art magic device.
Figure 2:
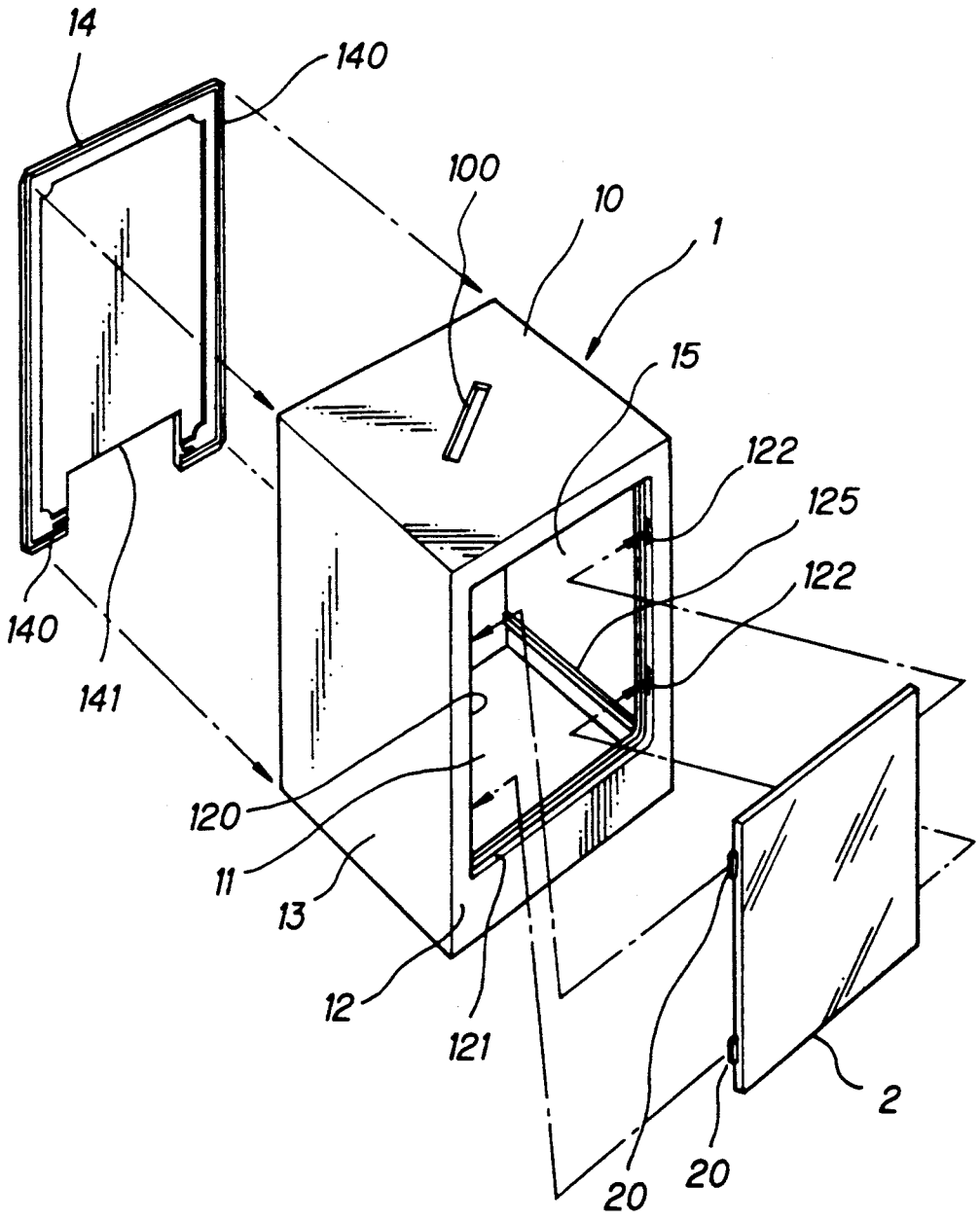
Figure 11:
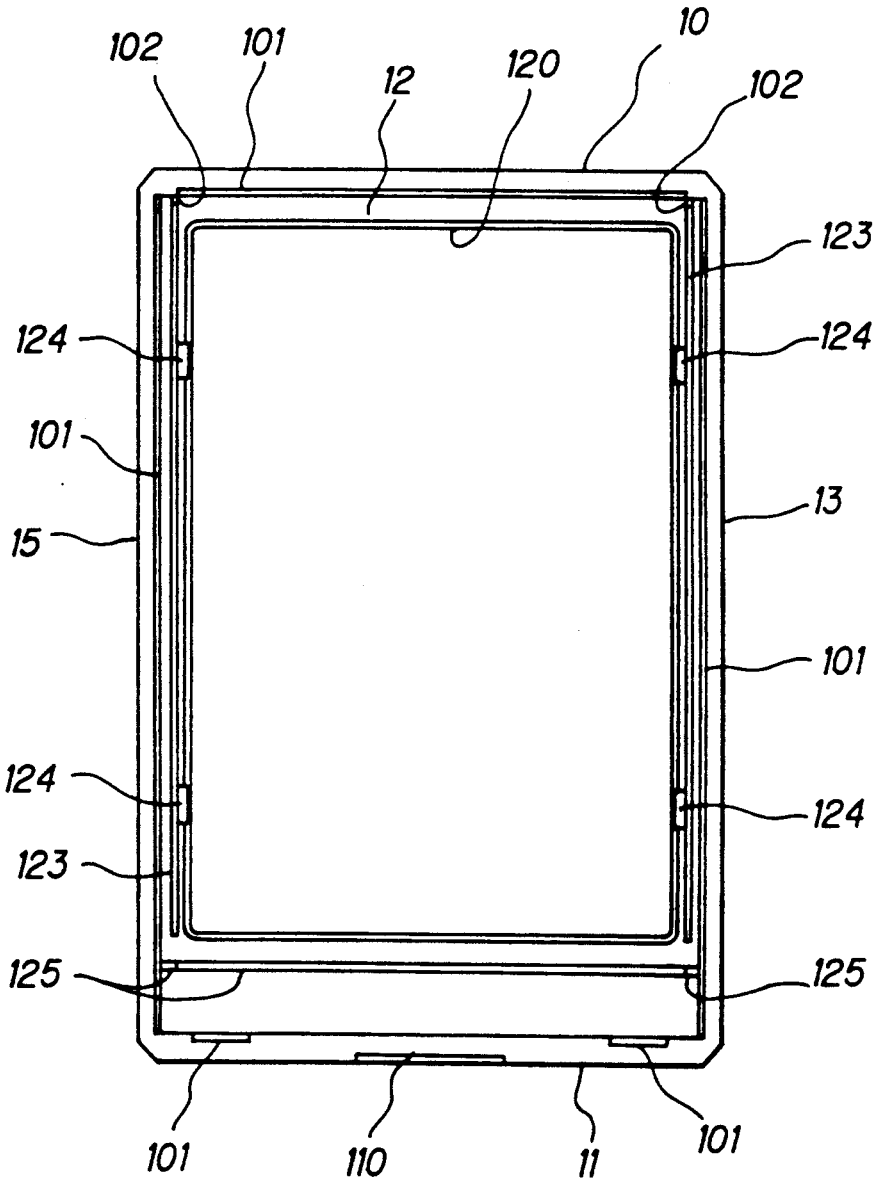

In Figures, the reference numeral 1 denotes a hollow, square box body having, as shown in FIGS. 2 and 11, a square top and bottom plates 10 and 11 having a same size, and four rectangular side plates of a same size, including a front plate 12, right plate 13, rear plate 14 and left plate 15. The box body 1 provides an internal space for the savings box according to the present invention. The top plate 10, bottom plate 11, front plate 12, right plate 13, rear plate 14 and left plate 15 are formed of an opaque synthetic resin. The front plate 12 has formed therein a rectangular opening 120 having a size smaller than the front plate 12 and also a step 121 formed circumferentially of the opening 120. There are formed two small recesses 122, upper and lower, in each of the right and left side walls contiguous to the step 121, of the opening 120 in the front plate 12. Small vertical guide projections 123 are formed on the right and left inner walls of the edge of the opening 120 in the front plate 12. The reference numeral 124 denotes openings for forming the small recesses 122. There are formed small lower horizontal guide projections 125 on the lower inner portion of the front plate 12 under the lower edge of the opening 120 as well as on the lower inner portions of the right and left plates 13 and 15, respectively. Small engagement projections 101 are formed on the rear end faces of the top plate 10, bottom plate 11 and right and left plates 13 and 15, respectively. There are formed on both the right and left inner end portions of the top plate 10 small upper guide projections 102 extending from the vertical guide projections 123, respectively. The top plate 10 has formed therein an elongated coin slot 100 communicating with the coin reception space 4 as will be described later. A semi-circular shallow concavity 110 is formed in the center of the front end face of the bottom plate 11. Also a narrow engagement recess 140 is formed circumferentially in the inner wall of the back plate 14. The back plate 14 is cut off in the center of the lower edge thereof in the form of an elongated rectangular cut indicated with a reference numeral 141. Thus, after the internal structure is housed in the box body 1 (except for the back plate 14), the engagement projections 101 of the box body 1 (except for the back plate 14) are fitted into the engagement recess 140 in the back plate 14 and the back plate 14 is assembled to the box body 1 (except for the back plate 14) by ultrasound welding, bonding or a similar method to complete the box body 1.

The reference numeral 2 in Figures denotes a rectangular transparent plate 2 made of a light-transparent synthetic resin. As shown in FIG. 2, the transparent plate 2 has a nearly same size as or somewhat smaller size than the opening 120 in the box body 1. The transparent plate 2 has two small projections 20, upper and lower, formed on either lateral end face thereof. The transparent plate 2 is assembled to the box body 1 in such a manner as to be flush therewith by engaging the small projections 20 of the plate 2 into the small recesses 122 in the box body 1, thereby forming the window 2 of the savings box. The inside of the box body 1 is viewed through this window (transparent plate) 2. It should be noted that the transparent plate 2 may be secured to the box body 1 by ultrasound welding, bonding or the like manner, not by the abovementioned engagement.

Figure 3:
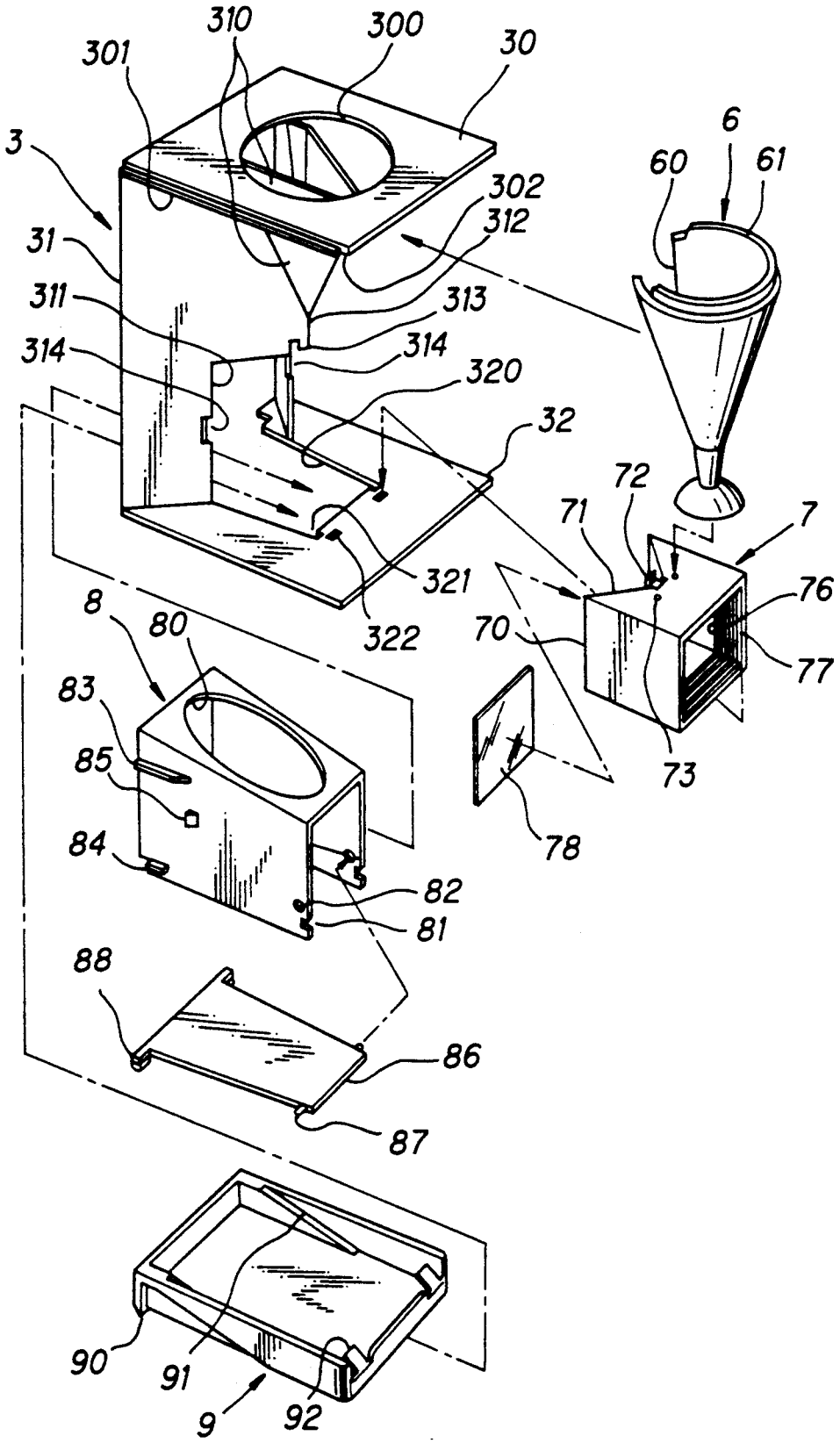
Figure 12:
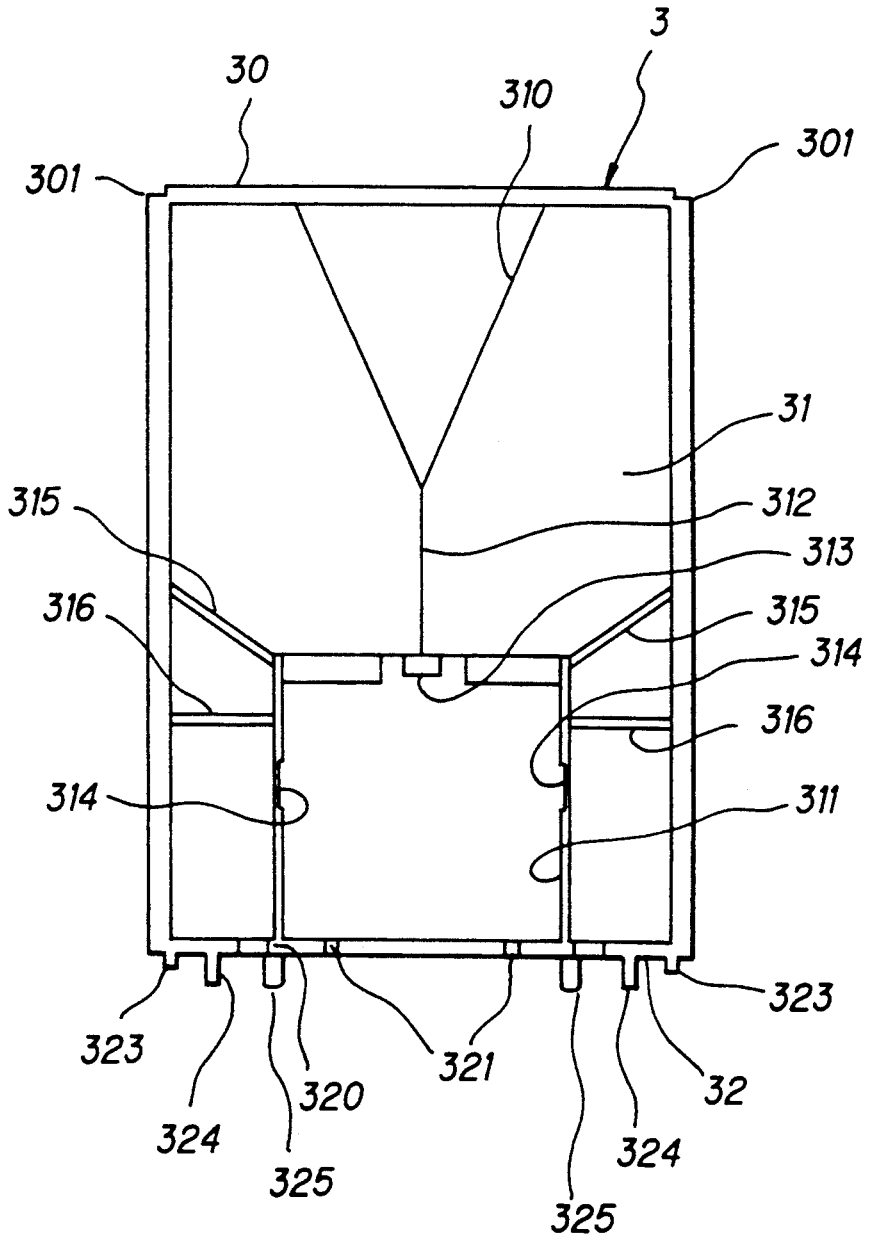
Figure 13:
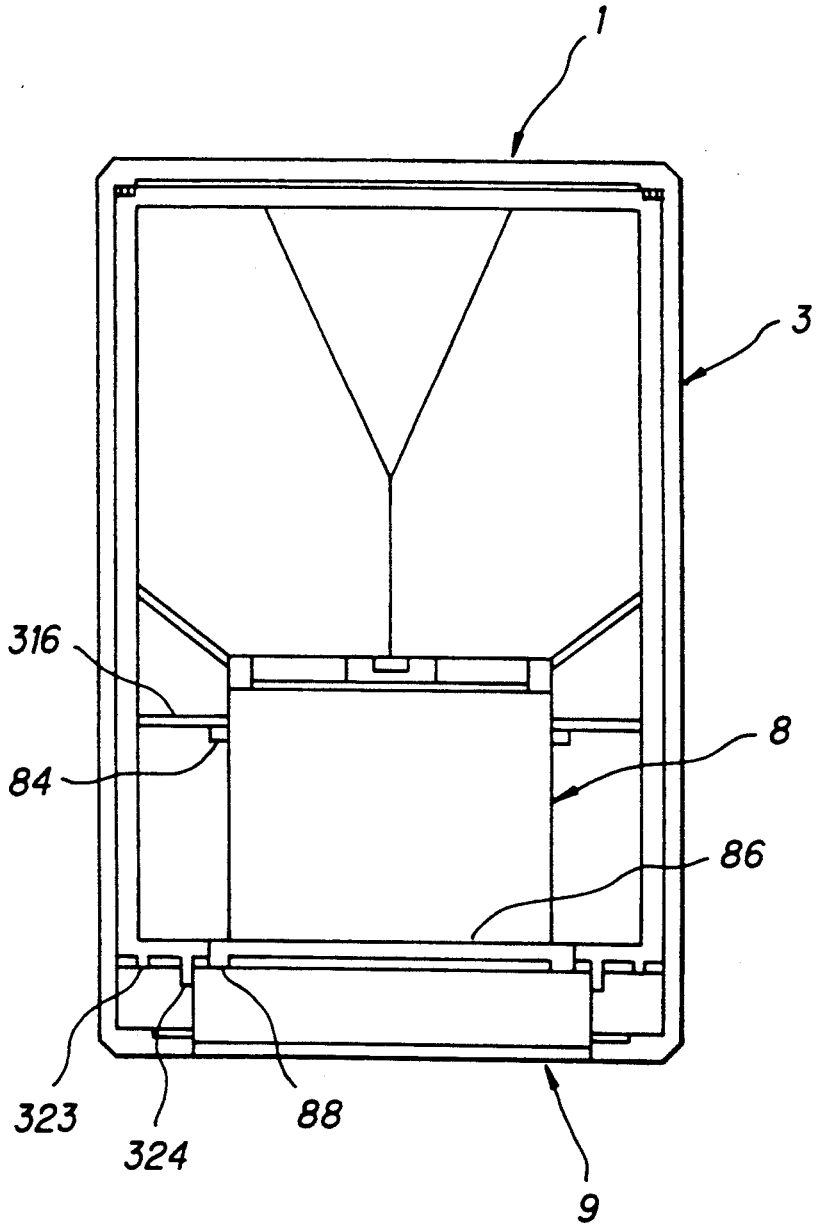
Figure 14:
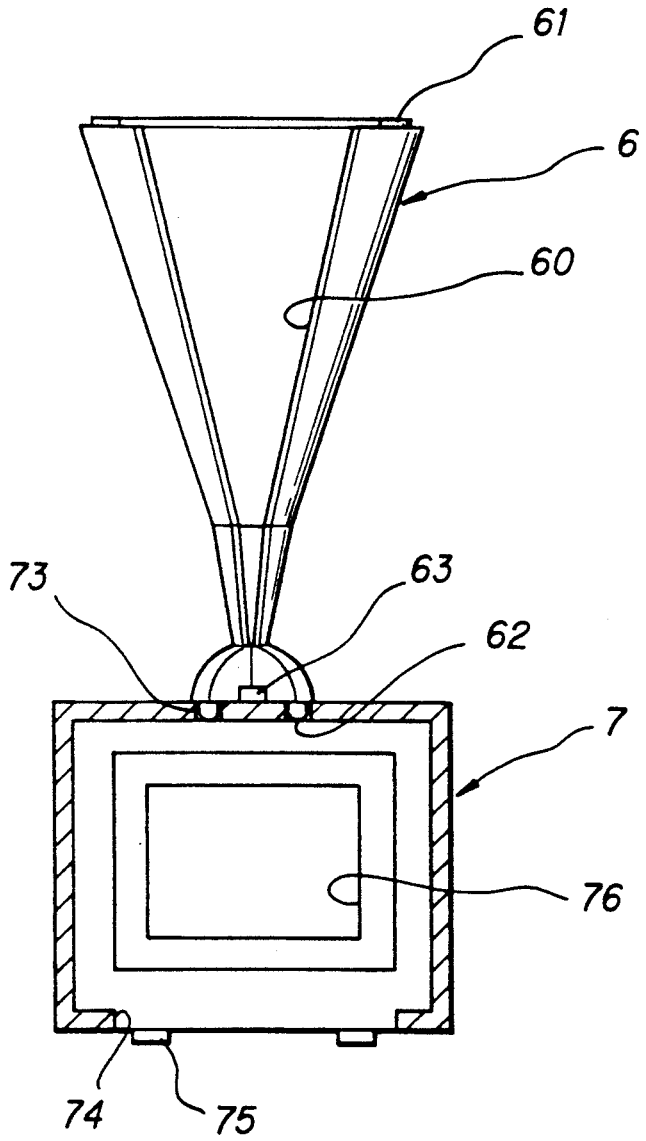

In Figures, the reference numeral 3 denotes a partition made, by molding, of an opaque synthetic resin. The partition 3 is used to divide the internal space of the box body 1 into a coin reception space 4 and magic space 40. As shown in FIGS. 3 and 12, the partition 3 consists of a top plate 30 of a size smaller than the top plate 10 of the box body 1, a side plate 31 consisting of two flat rectangular plates of which the long side slightly shorter than the distance from the lower side of the top plate 10 of the box body 1 to the upper side of the lower horizontal guide projection 125 and the shorter side has a length of $\sqrt{2}$ of about a half of one side of the top plate 10 of the box body 1, the two flat plates defining an angle of 90° (270°) between them, and a bottom plate 32 having a size smaller than the bottom plate 11 of the box body 1, one side of the top plate 30 and one side of the bottom plate 32 being coupled at a right angle integrally to the upper and lower edges, respectively, of the side plate 31. A circular opening 300 is formed in the middle of the top plate 30. The top plate 30 has provided at either lateral end face thereof small guide projections 301 which are cut, as indicated with a reference numeral 302, at the front end thereof to the height of the vertical guide projections 123 of the box body 1. There is provided above the front side of the side plate 31 a coin chute 310 opposing the coin slot 100 in the box body 1. The coin chute 310 has such a size as to be covered with the camouflaging member 6. The side plate 31 has formed in the lower middle of the side plate. 31 a cut 311 which provides a communication between the coin reception space 4 and magic space 40 through a second compartment 8 which will be explained later. There is provided an engagment projection 313 in the middle of the upper edge of the cut 311 of the side plate 31, that is, at the lower end of the bending line 312. An engagement recess 314 is formed in the center of each of the right and left sides of the cut 311 of the side plate 31. There are provided on the back of the side plate 31 coin deflectors 315 rising up obliquely from the corners of the cut 311 to both the right and left lateral sides of the side plate 31. Further, there are horizontal guides 316 provided on the back of the side plate 31 under the coil deflectors 315, respectively. The bottom plate 32 has formed in the center thereof a trapezoidal cut 320 extending to the rear edge thereof. This cut 320 serves to provide a communication between the second compartment 8 and a coin tray 9, both of which will be discussed later. There are formed engagement recesses 321 in either corner of the cut 320 in the bottom plate 32, and engagement projections 322 in the proximity of the recesses 321, respectively, on the bottom plate 32. The bottom plate 32 has formed on the rear side at the right and left sides thereof, outer and inner smaller guide projections extending in parallel to each other. Further, the guide projections 323 and 324 are cut at the front ends thereof to the height of the lower horizontal guide projection 125 of the box body 1 (not shown). Stopper pins 325 are formed at the right and left edges of the cut 320 on the rear side of the bottom plate 32.

Figure 7:
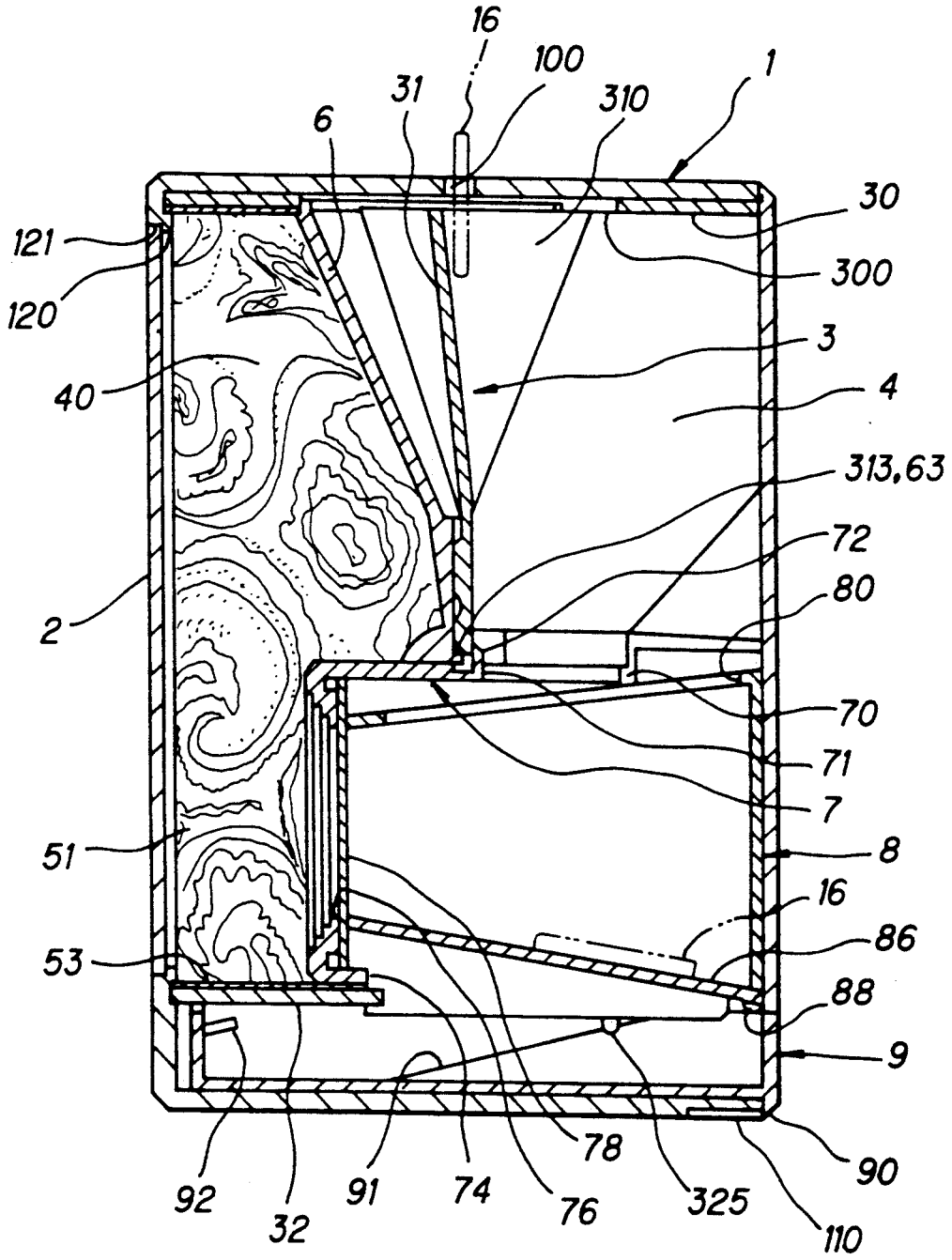
Figure 8:
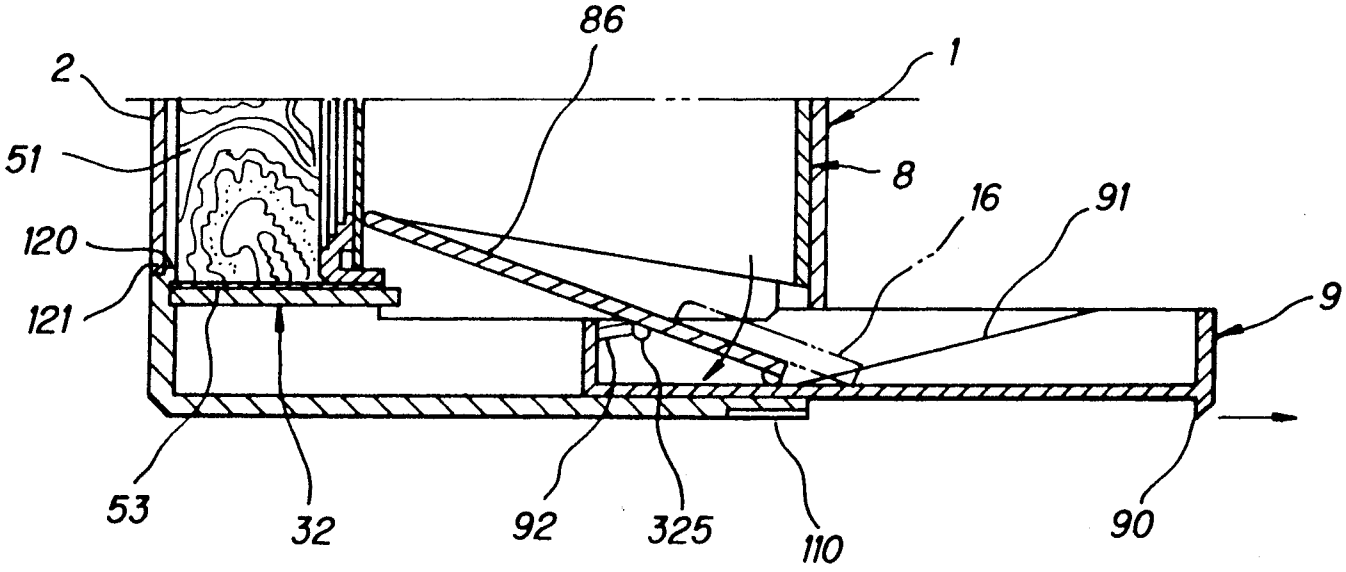
Figure 9:
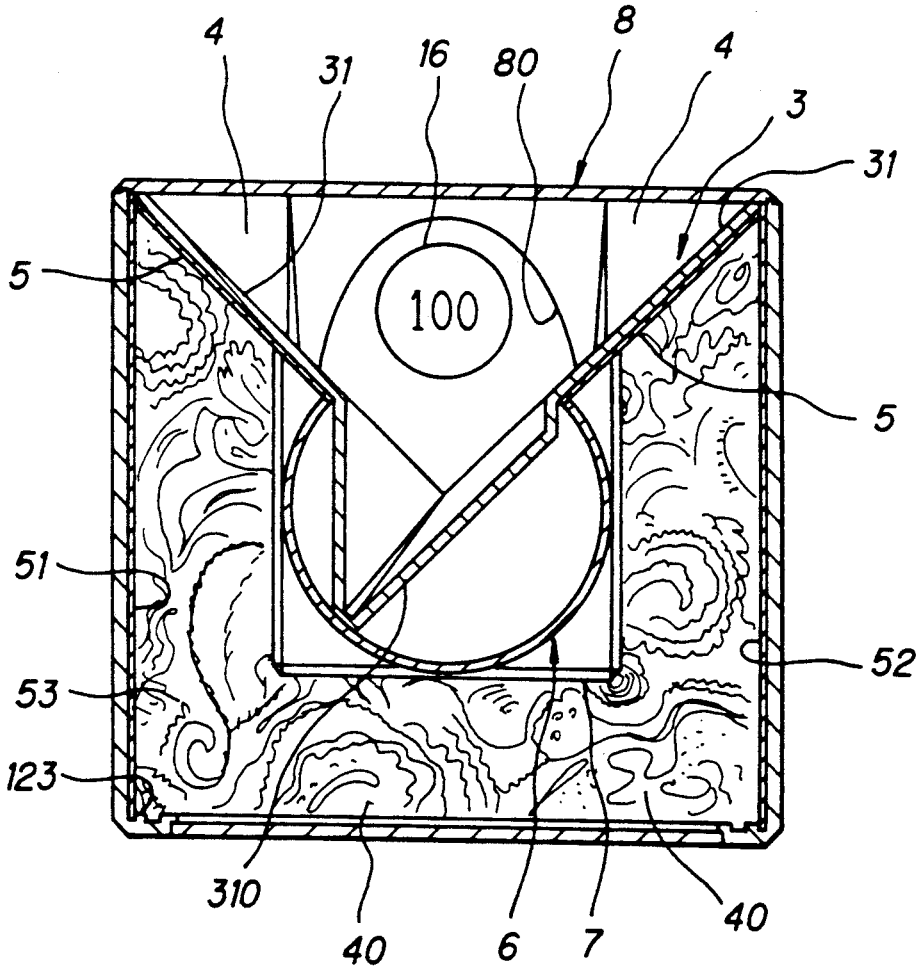
Figure 10:
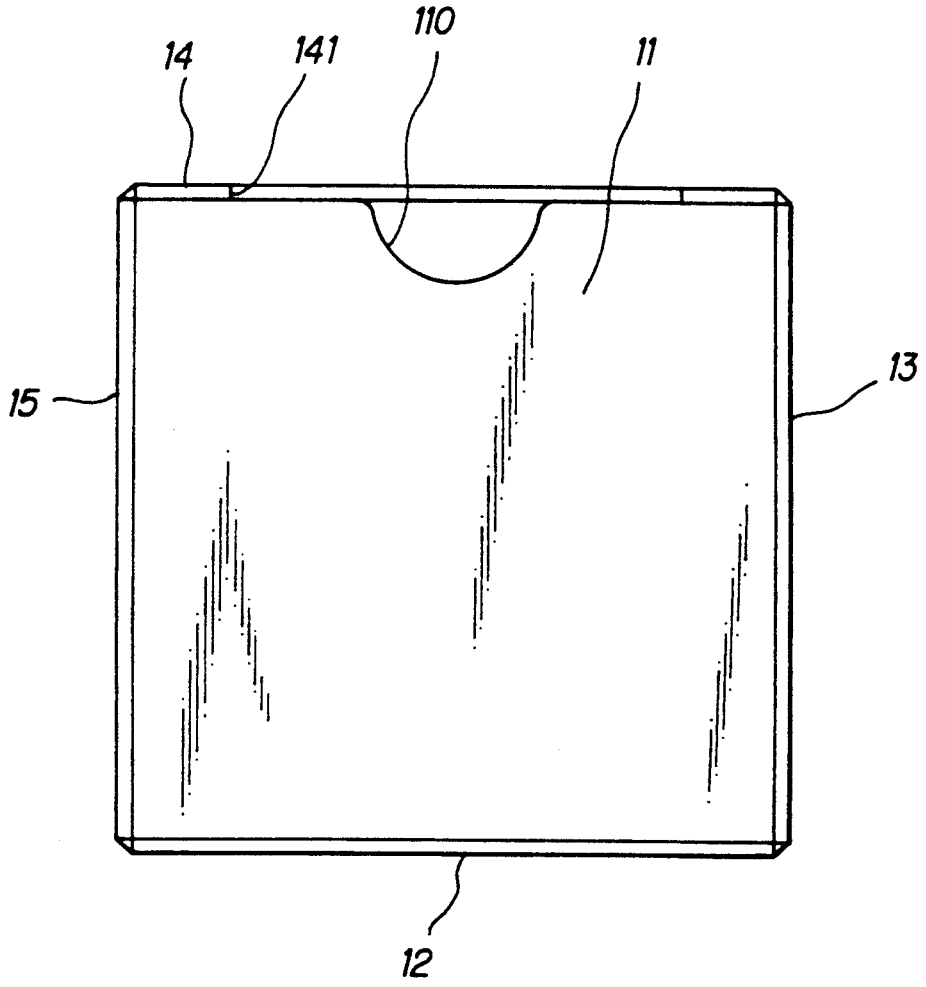

As shown in FIGS. 7 and 9, when the partition 3 is placed inside the box body 1, the side plate 31 consisting of the two flat plates takes a position perpendicular to the top and bottom plates 10 and 11 of the box body 1 with the top and bottom plates 30 and 32 interposed between the side plate 31 and top and bottom plates 10 and 11, thereby dividing the internal space of the box body 1 into two sub-spaces. More particularly, the partition 3 is assembled into the boxy body 1 in such a manner that the bending line 312 of the partition 3 is made to coincide with the center axis of the box body 1, the right and left sides of the partition 3 are placed at the two rear corners, respectively, of the box body 1 and the sub-space including the larger bending angle (270° ) of the partition 3 faces the window 2 of the box body 1. Thus, the internal space of the box body 1 is divided into two such sub-spaces, that is, a space 4 not facing the window 2 (will be referred to as "coin reception space" hereafter) and a space 40 facing the window 2 (will be referred to as "magic space" hereafter).

Figure 15:
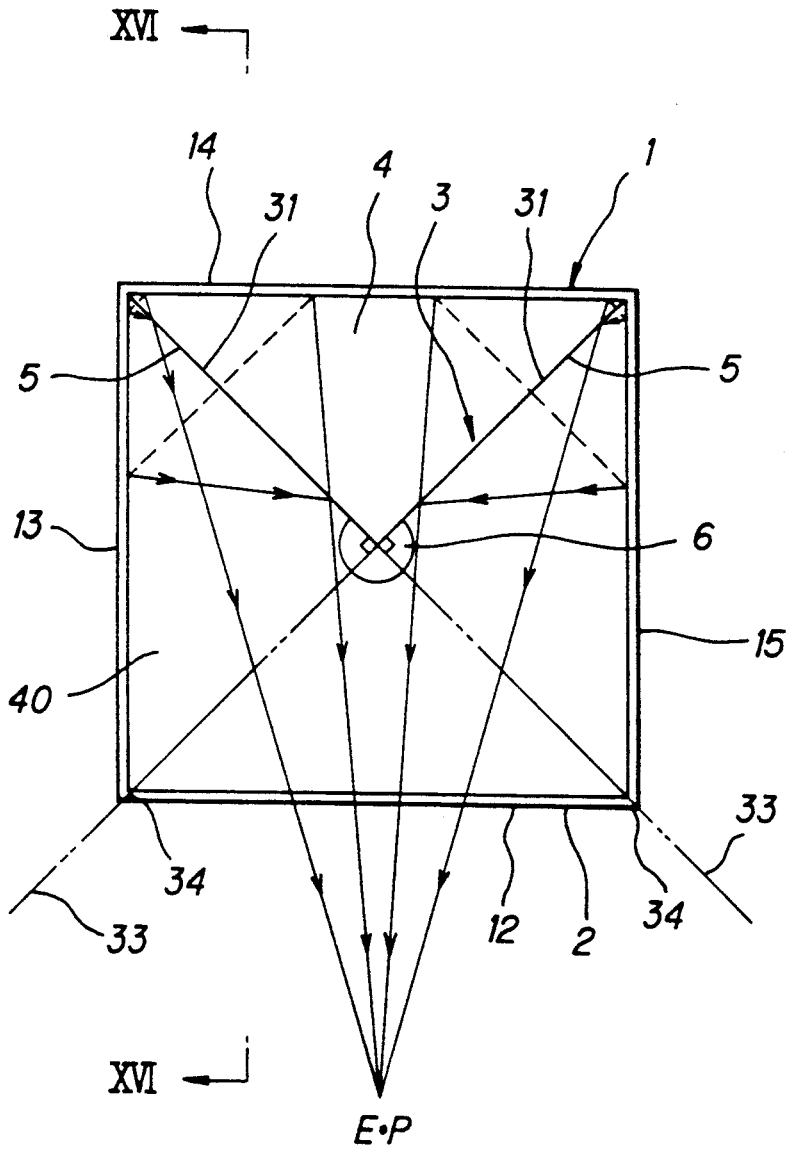

The window 20 is mounted in the opening in the front plate 12 opposing the larger bending-angle side (270° ) of the partition 3 between the lines 34 of intersection of the side walls (side plates 13 and 15) of the box body 1 with two planes 33 extending from the bending line 312 of the partition 3 perpendicularly to the planes, in which the two side plates 31 of the partition 3 lie, respectively. The larger bending angle of the partition 3 is 270° while the angles defined between the planes in which the two side plates 31 of the partition 3 lie, respectively, and the two extensions 33 of the planes are 90° , respectively. Thus, the angle formed between the two extensions 33 is 90° . In the geometric relation between the central angles and sides of a regular square, the central angle of 90° corresponds to one side of the square. thus, the angle defined between the two extensions 33, namely, the central angle 90° of the square box body 1, corresponds to one of the side plates (front 12, right 13, back 14 and left 15) of the square box body 1. Therefore, use as the window 2 of the opening formed in one of the side plates of the box body 1, or the front plate 12, and which is of a size smaller than the front plate 12 satisfactorily meets the above conditions, causing any special problem. If the window 2 exceeds in width the distance between the above-mentioned two extension 33, the outside of the window 2 is seen as reflected at a mirror 5 which will be discussed later and visible as shown in FIG. 15 when the inside of the box body 1 is viewed through the window 2 beyond the extensions 33. This is not preferable for the present invention. Therefore, the window must be provided between the two extensions 33.

Figure 4:
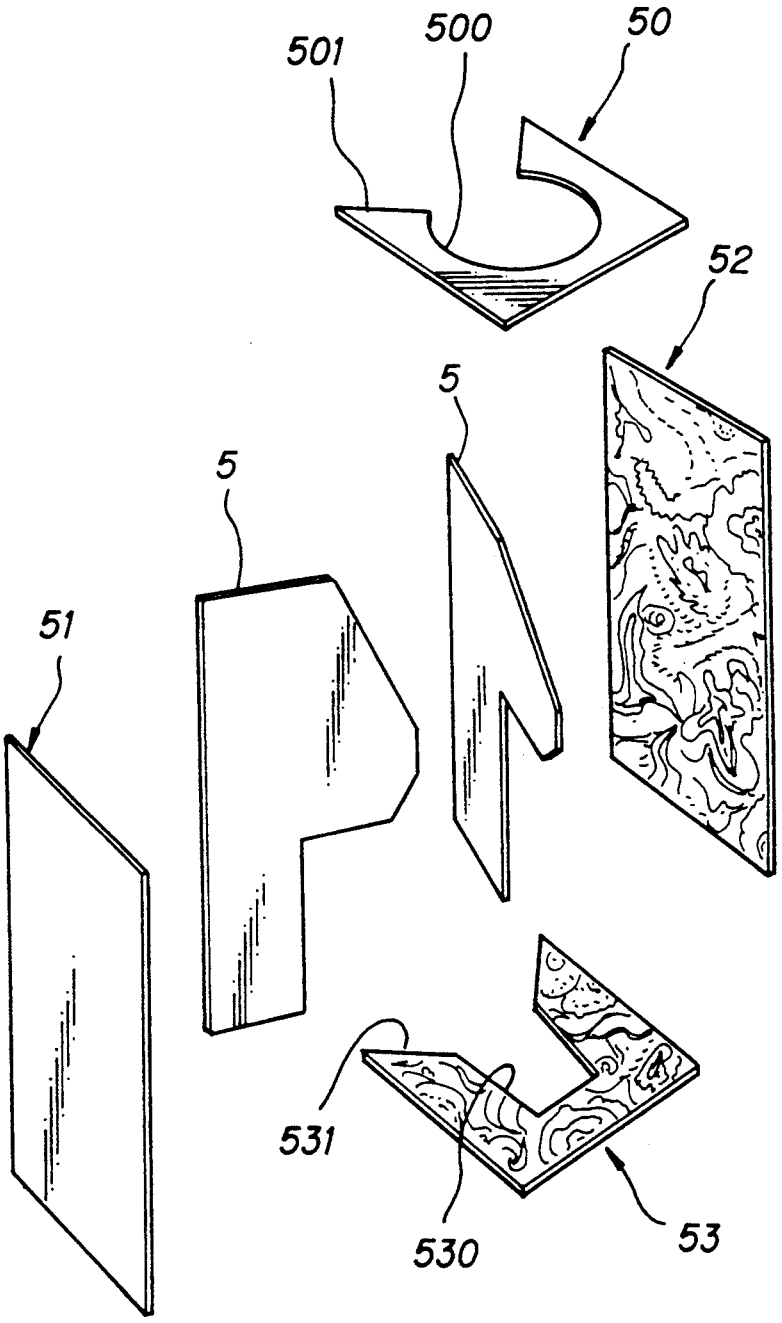

In Figures, the reference numeral 5 denotes a light reflecting area, or a mirror, disposed on the nearly entire surfaces of the side plate 31 of the partition 3 facing the window 2. The mirror 5 is an aluminum foil bonded (or an aluminum deposited) on a film of a synthetic resin, for example, as shown in FIG. 4. This mirror 5 is put on the surface of the side plate 31 of the partition 3 facing the window 2 by bonding (or as separated). The light reflecting area may be formed from an aluminum foil bonded or aluminum deposited directly on the surface of the side plate 31 of the partition 3 facing the window 2.

In Figures, reference numerals 50 and 51, and 52 and 53 denote pattern-printed sheets, respectively. As shown in FIG. 4, the pattern-printed sheets 50, 51, 52 and 53 are made each of a cardboard or the like having a pattern printed or otherwise processed on one side thereof as shown in FIG. 4. The pattern-printed sheet 50 for the top plate is of a nearly same size as the top plate 30 of the partition 3 and has formed in the center thereof a circular opening having a generally same size of the opening 300 in the partition 3. Also the sheet 50 is obliquely cut off at 501 from both rear corners thereof correspondingly to the angle defined between the plates 31 of the partition 3. The pattern-printed sheets 51 and 52 has a rectangular form of which the longer sides are somewhat shorter than the distance between the lower side of the top plate 10 of the box body 1 and the upper side of the lower horizontal guide projection 125 and the shorter sides are nearly equal in length to one side of the top and bottom plates 30 and 32 of the partition 3. The pattern-printed sheet 53 having a nearly same size as the bottom plate 32 of the partition 3 has formed in the center thereof a trapezoidal cut 530 of such a size as is slightly larger than the cut 320 in the partition 3, namely, as does not close the engagement recesses 322. Also the sheet 53 is obliquely cut off at 531 from both rear corners hereof correspondingly to the angle defined between the plates 31 of the partition 3.

In Figures, the reference numeral 6 denotes a camouflaging member having the form of a funnel of which the upper circular portion is somewhat larger than the circular hole 300 in the partition 3. The camouflaging member 6 has a cut 60 of which the central angle is 90°. The camouflaging member 6 is made of a light-opaque material, for example, an opaque synthetic resin. The camouflaging member 6 has a circular engagement projection 61 formed at the upper end thereof and an engagement projection 62 formed at the lower end thereof. Further there is formed an engagement projection 63 on the side of the cut 60 at the lower end of the camouflaging member 6.

In Figures, the reference numeral 7 denotes a first coin compartment. As shown in FIG. 3, this coin compartment 7 is a hollow cube having such a size that it covers the cut 311 in the partition 3 and also the cut 320 in the bottom plate 32 of the partition 3. It is made of a light-opaque material. The compartment 7 is cut off at 70 at the rear side thereof. The first compartment 7 has a right-angled triangular cut 71 formed in the upper side thereof correspondingly to the lower end of the cut 311 in the side plate 31 of the partition 3, and an engagement projection and two engagement recesses 73 formed in the middle of the upper side thereof. Also the first compartment 7 has formed in the lower side thereof a trapezoidal cut 74 slightly larger than the cut 320 in the partition 3, thus this size being such that the lower side will not close the engagement recesses 321. Two engagement projections 75 are formed at the edge of the cut 74. Furthermore, the first compartment 7 has three-steps slopes 77 formed at the front thereof and an opening 76 formed at the innermost portion of the slopes 77. The inside of a second compartment 8 which will be discussed later is seen through the opening 76 from the window 2.

In Figures, the reference numeral 78 denotes a Fresnel lens as an optical means fixed on the rear of the opening 76 of the second compartment 7. The Fresnel lens 78 is provided for a reduced-in-scale view of the inside of the second compartment 8 which will be discussed below.

In Figures, the reference numeral 8 denotes the second compartment. The second compartment 8 has the form of a small hollow truncated pyramid of which the rear side is larger while the front side is smaller as shown in FIG. 3. The second compartment 8 is made of a light-opaque material. The second compartment 8 is cut off at the front and bottom sides thereof as shown. Further there is an elongated opening 80 formed in the top the second compartment 8. The second compartment 8 has engagement recesses 81 formed in the right and left lateral sides of the front opening thereof, and small circular through-holes 82 formed above the engagement recesses 81. Further, guide projections 83 and 84 are provided at the upper and lower portions on the right and left lateral sides near the rear side of the second compartment 8, and an engagement projection 85 is formed between the upper and lower guide projections 83 and 84.

In Figures, the reference numeral 86 denotes a plate 86 provided to open and close the bottom opening of the second compartment 9 and the top opening of a coin tray 9 which will be discussed later. The plate 86 is made of a light-opaque material and has the form of a trapezoid. The plate 86 has engagement projections 87 formed on either end face at the shorter side thereof, and sliding projections 88 formed on either end face at the longer sides thereof. The plate 86 is openably mounted to the edges of the bottom opening in the second compartment 8 with the engagement projections 87 of the plate 86 pivotably engaged in the through-holes 82 in the second compartment 8. The square opening defined by the bottom opening edges of the second compartment 8 and front end of the plate 86 is of a same size of the opening 76 of the first compartment 7.

The second compartment 8 is provided to prevent the internal space of the first compartment 7 from seeming narrower as it goes deeper when viewed through the Fresnel lens 78. That is, when the inside of the second compartment 8 placed in the first compartment 7 is viewed through the Fresnel lens 78, an illusion is given that the Fresnel lens 78 for reduced-in-scale view does not exist there and the internal space of the first compartment 7 looks as if it were a complete cubic space. The second compartment 8 serves to receive coins thrown into the box.

In Figures, the reference numeral 9 denotes a coin tray. As shown in FIG. 3, the coin tray 9 has the form of a thin rectangle of which the top is open, and is made of a same material as the box body 1. The tray 9 has a projection 90 formed on the lower rear edge thereof, and sliding faces 91 formed on the inner walls of the right and left lateral sides thereof, the sliding faces 91 sloping down from the rear end toward the intermediate portion. Furthermore, stoppers 92 are formed at the right and left front ends of the tray 9, and they are directed slightly upward.

The savings box according to the present invention is assembled as in the following:

First the top pattern-printed sheet 50 is set on the inner wall of the top plate 30 of the partition 3. The bottom pattern-printed sheet 53 is placed on the top of the bottom plate 32 of the partition 3, and the two mirrors 5 are set on the front faces of the two side plates 31 of the partition 3. Then, with the engagement projections 75 of the first compartment 7 engaged in the engagement recesses 322 in the partition 3, the first compartment 7 is installed to the partition 3. At this time, the first compartment 7 will cover the cut 311 in the side plate 31 of the partition 3 and the cut 320 in the bottom plate 32 and also take a position in the magic space 40. Next, the Fresnel lens 78 is put in the first compartment 7 and placed at the rear edges of the opening 76, and then the second compartment 8 is fitted into the first compartment 7. With the engagement projections 321 of the partition 3 engaged in the respective engagement recesses 81 of the second compartment 8, the engagement projections 85 of the second compartment 8 are engaged in the engagement recesses 314 of the partition 3 and the second compartment 8 is pushed into the first compartment 7 with the upper and lower guide projections 83 and 84 of the second compartment 8 guided between the bottom plate 32 and horizontal guides 316 of the partition 3, thereby installing the second compartment 8 to the partition 3. When the inside of the second compartment 8 is viewed through the Fresnel lens 78, the internal space of the first compartment 7 looks as if it were a complete cubic space, the front half of the second compartment 8 looks as if it were positioned inside the first compartment 7, and the rear half of the second compartment 8 looks as if it were positioned in the coin reception space. The opening 80 of the second compartment 8 opposes the coin chute 310 of the partition 3. Further, the engagement projection 61 of the camouflaging member 6 is engaged on the edge of the circular opening 300 in the partition 3, the engagement projections 62 of the camouflaging member 6 are engaged in the respective engagement recesses 73 in the first compartment 7, and the engagement projection 63 of the camouflaging member 6 is engaged on the engagement projection 72 of the first compartment 7, thereby installing the camouflaging member 6 to the partition 3. At this time, the joint between the two mirrors 5 and their inner edges are concealed by the camouflaging member 6 and first compartment 7, thereby giving an illusion that the mirrors 5 do not exist, to make the savings box according to the present invention more enjoyable to see. The internal structure is thus set. It should be noted that the internal structure is assembled as having been described above, without using any adhesive or ultrasound welding. However, it may be assembled using an adhesive or an ultrasound welding as necessary.

Then the upper, front and lower edges of the pattern-printed sheets 51 and 52 on the right and left lateral plates are engaged on the upper horizontal guide projection 102, vertical guide projection 123 and lower horizontal guide projection 125, respectively, of the box body 1. Next, the internal structure as mentioned above is put into the box body 1 with the guide projection 301 and outer guide projection 323 of the partition 3 of the internal structure being guided on the upper and lower horizontal guide projections 102 and 125, respectively, of the box body 1. At this time, the internal space of the box body 1 is divided by the partition 3 into the coin reception space 4 and magic space 40, the coin slot 100 of the box body 1 opposes the upper opening of the coin chute 310 of the partition 3, and the mirror 5 and pattern-printed sheets 50, 51, 52 and 53 are positioned within the magic space 40 of the box body 1. The back plate 14 is fixed to the edges of the rear opening of the box body 1 by means of ultrasound welding or the like. Further, the coin tray 9 is put through the cut 141 in the back plate 14 (box body 1) into the internal space of the box body 1, that is, a space defined by the bottom plate 11 of the box body 1, bottom plate 32 and inner guides 324 of the partition 3. At this time, the stoppers 92 of the coin tray 9 are forced down once by the stopper pins 325. When the stoppers 92 are moved in beyond the stopper pins 325, they restore their initial positions due to their resilience. When the tray 9 is drawn out, the stoppers 92 in these positions abut the stopper pins 325 to prevent the tray 9 from coming off the box body 1. Also the sliding projections 88 of the second compartment 8 ride on the sliding faces 91 of the tray 9 so that the sliding projections 88 slide on the sliding faces 91 to open and close the plate 86 when the tray 9 is moved, namely, when it is drawn and inserted.

In the embodiment of savings box according to the present invention, the Fresnel lens 78 located at the opening 76 of the first compartment provides a reduced-in-scale view of the coins 16 in the first compartment 7 when the inside of the compartment 7 is viewed from the window 2. Therefore, a coin 16 through into the first compartment 7 from the coin slot 100 in the box body 1 looks as if it had been reduced in size when it passes through the camouflaging member 6. So the savings box according to the present invention is not only used for saving such coins but also it is enjoyable to see.

Figure 5:
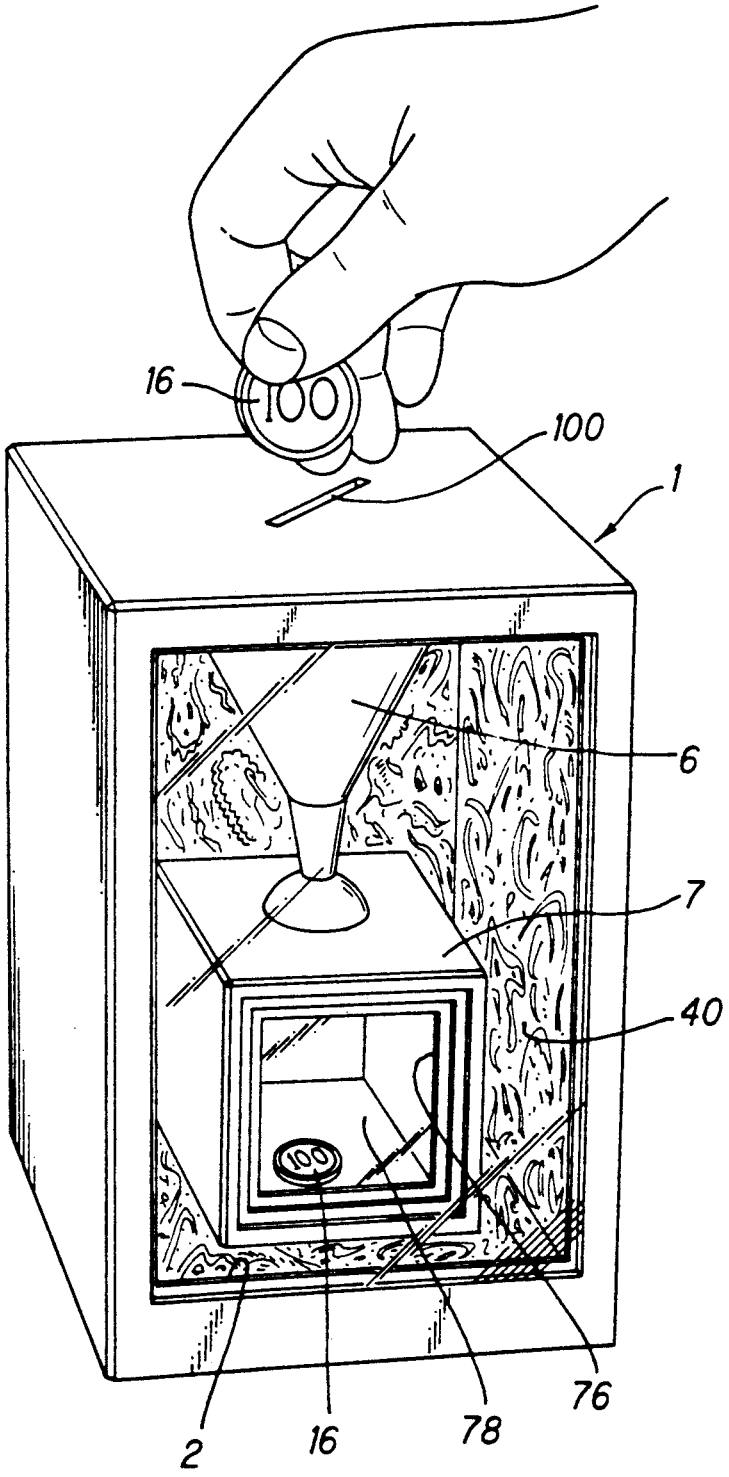
Figure 6:
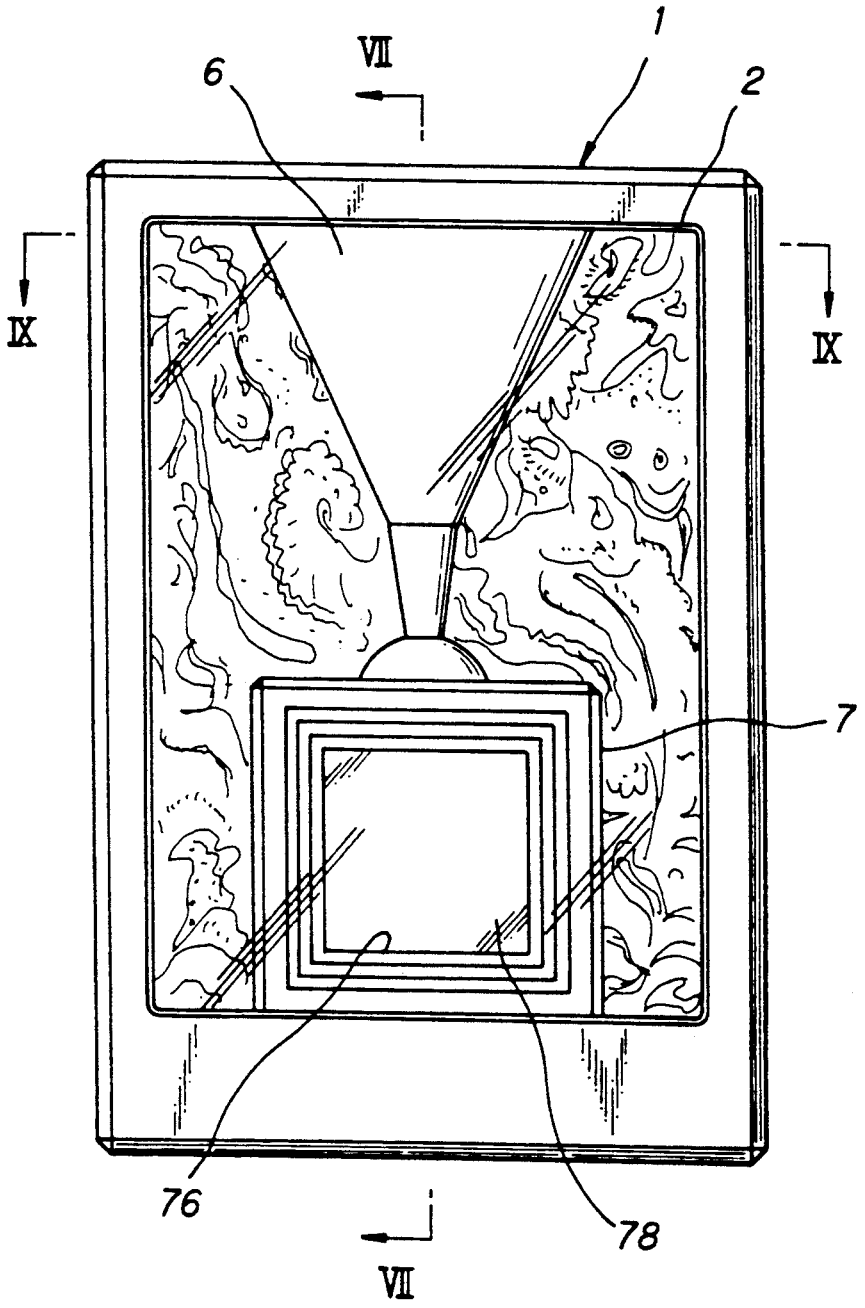
Figure 16:
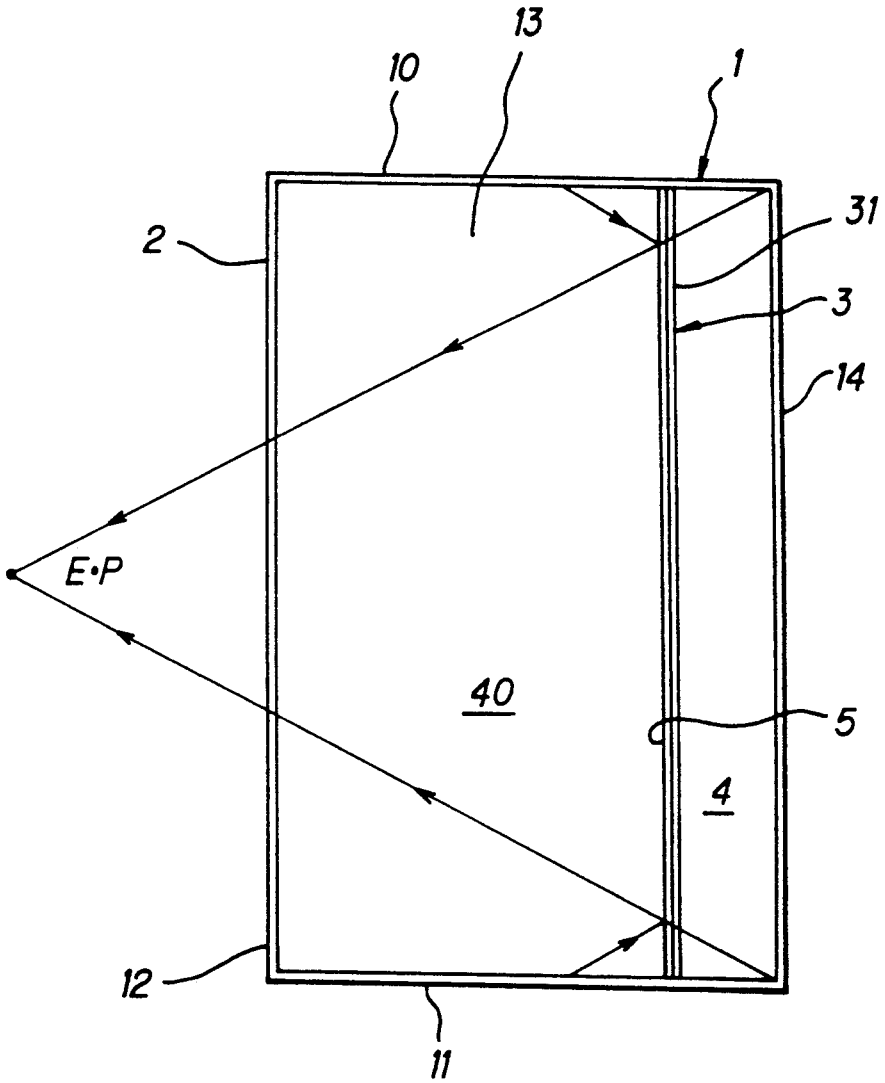

In the embodiment of savings box according to the present invention, the internal space of the hollow square box body 1 is divided by the partition 3 into the coin reception space 4 and magic space 40, one of which, namely, the coin reception space 4 is concealed by the partition 3. In the other space, or the magic space 40, the patterns of the pattern-printed sheets 50, 51, 52 and 53, the outer surface of the camouflaging member 6 and the outer surface of the first compartment 7 are seen as reflected on the mirror 5 when viewing the inside of the box body 1 through the window 2 from the point E.P., as shown in FIGS. 15 and 16. Thus, the patterns of the pattern-printed sheets 50, 51, 52 and 53 on the inner walls of the magic space 40, the outer surface of the camouflaging member 6 and the outer surface of the first compartment 7, reflected at the mirror 5 look as if they were the pattern-printed sheets on the rest of the inner walls of the savings box, the rest of the outer surface of the camouflaging member 6 and the rest of the first compartment 7, respectively. Namely, when the inside of the box body 1 is viewed from the window 2, an illusion is given, as shown in FIGS. 5 and 6, that a funnel-like coin chute (camouflaging member 6) and a rectangular coin compartment (first compartment 7) exist in a hollow box without any partition (partition 3).

Looking into the second compartment 8 through the opening 76 and Fresnel lens 8 in the first compartment 7 from the window 2, the user throws a coin 16 from the coin slot 100 into the box body 1. Although the coin 16 is actually put in the second compartment 8, the user will find the coin 16 as if it were put in the cubic first compartment 7 located in the center of the hollow box body 1, as will be seen from FIGS. 5, 7 and 9.

Thus, the embodiment of the savings box according to the present invention is enjoyable to see.

When the coin tray 9 is drawn out of the box body 1 with the fingers applied to the projection 90 of the tray 9 at the shallow concavity 110 on the bottom of the box body 1, the plate 86 of the second compartment 8 is opened, the coin 16 there will drop down to the coin tray 9 and thus can be taken out.

In the aforementioned embodiment, the camouflaging member 6 has the form of a funnel and the first compartment is cubic in shape. However, the shapes of these members are not limit to such funnel-like or cubic ones. The camouflaging member and first compartment may be integrally formed like, for example, a pot of which the neck portion is to serve as the camouflaging member while the bottom is serving as the compartment.

Also in the above embodiment, the first compartment 7 has the opening 76 formed thereon. It should be noted, however, that an opening may be formed in the camouflaging member 6 as well. Furthermore, there may be formed a cut for communication between the internal space of the camouflaging member 6 and the coin reception space 4.

Further in the above embodiment, the pattern-printed sheets 50, 51, 52 and 53 provided on the inner walls of the magic space 40 of the box body 1 permit to camouflage the edge of the partition 3 provided in the box body 1 and those of the mirrors attached thereon and esthetically enhance the inside of the box body 1. Also, there may be provided a pattern or decoration or both on the outer surfaces of the camouflaging member 6 and first compartment 7, and a decoration may be provided on the pattern-printed sheets 50, 51, 52 and 53.

In addition, there may be provided in the coin reception space 4 in this embodiment a music box or the like which is put into operation each time a coin 16 is put into the reception space 4 from the coin slot 100 to play a music, which will also make the savings box enjoyable to hear.

Furthermore in the above embodiment, the box body 1 has the form of a hollow square column. However, this form may be a polygonal column, cylinder, elliptic column, truncated cone, or a trapezoid.

The angle defined by the planes of the two side plates 31 of the partition is an arbitrary one. Further, the size and shape of the window 2 is not limited any way so long as it is between the two extensions 33. Also, the window 2 may not be any transparent plate but it may be just as an opening.

In the aforementioned embodiment, the second compartment 8 is used, but it is not always necessary.

What is claimed is:

1. A savings box, comprising:

a box body consisting of an opaque enclosure having an internal space;

a partition having panels lying in two planes which intersect at a line of bending of the partition and define an arbitrary internal angle between them, said internal angle being a smaller angle than a surrounding external angle, and said partition being installed inside said box body to divide the internal space of said box body into a first space including said external angle and a second space including the smaller internal angle;

a cut formed in said partition to provide a communication between said first and second spaces in said box body;

a light-transparent window through which said first space is viewable and which is located between lines of intersection between each of a pair of opposite walls of said box body and a respective plane extending from the line of bending of said partition perpendicularly to a respective one of the panels of the partition;

a light reflecting area defined over said panels of said partition at a side thereof facing the first space;

a coin slot formed in said box body to communicate with said second space;

a light-opaque camouflaging member so secured to said partition as to cover the bending line at said side of the panels over which the light reflecting area is defined;

a light-opaque compartment provided contiguously to said camouflaging member and which covers said cut;

an opening formed in said compartment and through which the inside of said compartment is seen and said second space is seen through said cut; and an optical means provided at said opening of said compartment to provide a reduce-in-scale view of the inside of said compartment and the second space.

2. A savings box as set forth in claim 1, wherein said box body has the form of a hollow rectangular parallelepiped and is made of a top and bottom plates, right and left side plates and a bottom plate.

3. A savings box as set forth in claim 2, further comprising a second compartment provided in said first compartment and second space, said second compartment being made of a light-opaque material and having formed therein an opening communicating with said second space, said second compartment being adapted to give an illusion that when the inside thereof is viewed through said optical means, the inside of said compartment is seen in its life size without said optical means.

4. A savings box as set forth in claim 2, wherein there is extractably disposed in said box body a coin tray having an opening which communicates with the inside of said compartment and said second space and in which there is openably installed a light-opaque plate which is opened when said coin tray is drawn out while being closed when said tray is pushed in.

5. A savings box as set forth in claim 3, wherein there is extractably disposed in said box body a coin tray having an opening which communicates with the inside of said second compartment and in which there is openably installed a light-opaque plate which is opened when said coin tray is drawn out while being closed when said tray is pushed in.

6. A savings box as set forth in claim 2, wherein pattern-printed sheets are provided on the inner walls of said box body which define together said first space.

7. A savings box as set forth in claim 3, wherein pattern-printed sheets are provided on the inner walls of said box body which define together said first space.

8. A savings box as set forth in claim 4, wherein pattern-printed sheets are provided on the inner walls of said box body which define together said first space.

9. A savings box as set forth in claim 5, wherein pattern-printed sheets are provided on the inner walls of said box body which define together said first space.

10. A savings box as set forth in claim 2, said camouflaging member having the form of a funnel of which the upper portion has a larger diameter while the lower portion has a smaller diameter.

11. A savings box as set forth in claim 3, said camouflaging member having the form of a funnel of which the upper portion has a larger diameter while the lower portion has a smaller diameter.

12. A savings box as set forth in claim 4, said camouflaging member having the form of a funnel of which the upper portion has a larger diameter while the lower portion has a smaller diameter.

13. A savings box as set forth in claim 5, said camouflaging member having the form of a funnel of which the upper portion has a larger diameter while the lower portion has a smaller diameter.

14. A savings box as set forth in claim 6, said camouflaging member having the form of a funnel of which the upper portion has a larger diameter while the lower portion has a smaller diameter.

15. A savings box as set forth in claim 7, said camouflaging member having the form of a funnel of which the upper portion has a larger diameter while the lower portion has a smaller diameter.

16. A savings box as set forth in claim 8, said camouflaging member having the form of a funnel of which the upper portion has a larger diameter while the lower portion has a smaller diameter.

17. A savings box as set forth in claim 9, said camouflaging member having the form of a funnel of which the upper portion has a larger diameter while the lower portion has a smaller diameter.

* * * * *